US009848270B2

(12) United States Patent
Miki

(10) Patent No.: US 9,848,270 B2
(45) Date of Patent: Dec. 19, 2017

(54) ELECTRONIC DEVICE, EARPHONE, AND ELECTRONIC DEVICE SYSTEM

(71) Applicant: KYOCERA CORPORATION, Kyoto (JP)

(72) Inventor: Yasuhiro Miki, Ikoma (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/359,228

(22) Filed: Nov. 22, 2016

(65) Prior Publication Data

US 2017/0078815 A1 Mar. 16, 2017

Related U.S. Application Data

(63) Continuation of application No. PCT/JP2015/065265, filed on May 27, 2015.

(30) Foreign Application Priority Data

May 28, 2014 (JP) ..... 2014-110606

(51) Int. Cl.

| | |
|---|---|
| ***H04R 29/00*** | (2006.01) |
| ***H04R 1/10*** | (2006.01) |
| ***H04R 3/00*** | (2006.01) |
| ***H04R 17/00*** | (2006.01) |
| *H01R 24/58* | (2011.01) |
| *H01R 107/00* | (2006.01) |

(52) U.S. Cl.

CPC ..... *H04R 29/004* (2013.01); *H04R 1/10* (2013.01); *H04R 3/00* (2013.01); *H04R 17/00* (2013.01); *H01R 24/58* (2013.01); *H01R 2107/00* (2013.01)

(58) Field of Classification Search

CPC ..... H04R 1/10; H04R 3/00; H04R 29/004; H04R 29/17; H01R 24/58; H01R 2107/00

USPC ..... 381/74, 58, 123, 270, 384, 109, 111; 439/628.21

See application file for complete search history.

(56) References Cited

U.S. PATENT DOCUMENTS

2012/0294454 A1 11/2012 Sakamoto et al.
2014/0064512 A1* 3/2014 Yu ..... H01R 24/58 381/74
2014/0072129 A1* 3/2014 Jung ..... G06F 13/4068 381/58

FOREIGN PATENT DOCUMENTS

JP 2013-066149 4/2013

* cited by examiner

*Primary Examiner* — Melur Ramakrishnaiah
(74) *Attorney, Agent, or Firm* — Duane Morris LLP

(57) ABSTRACT

A third terminal of a five-electrode plug is connected to a power supply terminal of a first differential amplifier and a power supply terminal of a second differential amplifier in an earphone. The first differential amplifier and the second differential amplifier supply amplified voltages to a first piezoelectric element and a second piezoelectric element, respectively. A battery is connected to a third terminal of an earphone jack. A processor is connected to a sixth terminal of the earphone jack and determines insertion of a plug into the earphone jack.

15 Claims, 16 Drawing Sheets

ELECTRONIC DEVICE, EARPHONE, AND ELECTRONIC DEVICE SYSTEM

CROSS-REFERENCE TO RELATED APPLICATION

The present application is a continuation based on PCT Application No. PCT/JP2015/065265 filed on May 27, 2015, which claims the benefit of Japanese Application No. 2014-110606, filed on May 28, 2014. PCT Application No. PCT/JP2015/065265 is entitled "Electronic Device, Earphone, and Electronic Device System," and Japanese Application No. 2014-110606 is entitled "Electronic Device, Earphone, and Electronic Device System." The content of which is incorporated by reference herein in the entirety.

FIELD

The present disclosure relates to an electronic device, an earphone, and an electronic device system.

BACKGROUND

An apparatus which can identify which of a plurality of types of plugs has been inserted in an earphone jack has been known.

For example, a portable telephone including an earphone jack for five electrodes commonly used for a four-electrode plug and a five-electrode plug has been known. The four-electrode plug transmits a microphone signal, a left audio signal, a right audio signal, and a ground voltage, and the five-electrode plug transmits a PTT switch signal, a microphone signal, a left audio signal, a right audio signal, and a ground voltage.

When a plug is inserted, a tone signal is output from a third jack terminal. When a four-electrode plug is inserted here, the tone signal is output from a first jack terminal through a four-electrode earphone as a leakage signal, which is input to a control circuit after it is amplified. When a five-electrode plug is inserted, no leakage signal is output. According to such a configuration, which of the four-electrode plug and the five-electrode plug has been inserted into the plug can be identified.

SUMMARY

A five-electrode plug earphone in one embodiment includes a first differential amplifier configured to include a first input terminal, a second input terminal, a power supply terminal, and a ground terminal and to amplify a difference between a voltage of the first input terminal and a voltage of the second input terminal, a second differential amplifier configured to include a first input terminal, a second input terminal, a power supply terminal, and a ground terminal and to amplify a difference between a voltage of the first input terminal and a voltage of the second input terminal, a first piezoelectric element configured to receive a voltage amplified by the first differential amplifier, a second piezoelectric element configured to receive a voltage amplified by the second differential amplifier, a microphone including an output terminal and a ground terminal, and a five-electrode plug including a first terminal, a second terminal, a third terminal, a fourth terminal, and a fifth terminal sequentially from a tip end. The first terminal is configured to be connected to the first input terminal of the first differential amplifier. The second terminal is configured to be connected to the first input terminal of the second differential amplifier. The third terminal is configured to be connected to the power supply terminal of the first differential amplifier and the power supply terminal of the second differential amplifier. The fourth terminal is configured to be connected to the ground terminal of the first differential amplifier, the ground terminal of the second differential amplifier, and the ground terminal of the microphone and further configured to be connected to the second input terminal of the first differential amplifier and the second input terminal of the second differential amplifier. The fifth terminal is configured to be connected to the output terminal of the microphone.

An electronic device in another embodiment includes an earphone jack which can be connected to a five-electrode plug earphone. The earphone jack includes a first terminal, a second terminal, a third terminal, a fourth terminal, a fifth terminal, and a sixth terminal in the order of proximity to an insertion port. The electronic device further includes a microphone audio processing unit configured to be connected to the first terminal of the earphone jack, a ground power supply configured to be connected to the second terminal of the earphone jack, an electric power supply unit configured to be connected to the third terminal of the earphone jack, a first audio output unit configured to be connected to the fourth terminal of the earphone jack, a second audio output unit configured to be connected to the fifth terminal of the earphone jack, and a processor configured to be connected to the sixth terminal of the earphone jack and configured to determine insertion of a plug into the earphone jack.

The foregoing and other objects, features, aspects and advantages of the present disclosure will become more apparent from the following detailed description of the present disclosure when taken in conjunction with the accompanying drawings.

DETAILED DESCRIPTION

An embodiment will be described below with reference to the drawings.

When a speaker in an earphone is configured with a piezoelectric element, in order to operate the piezoelectric element, a voltage should be supplied to the piezoelectric element. A five-electrode earphone jack of a portable telephone described in the background art, however, cannot supply a voltage to the earphone. Such a problem can be solved by the disclosure below.

An electronic device according to an embodiment allows connection of a new five-electrode plug earphone in addition to a three-electrode plug earphone and a four-electrode plug earphone described in the background art, and performs a function to determine which plug is connected.

Description will be given below with reference to a portable terminal such as a smartphone as one form of an electronic device.

(Configuration of Portable Terminal)

Figure 1:
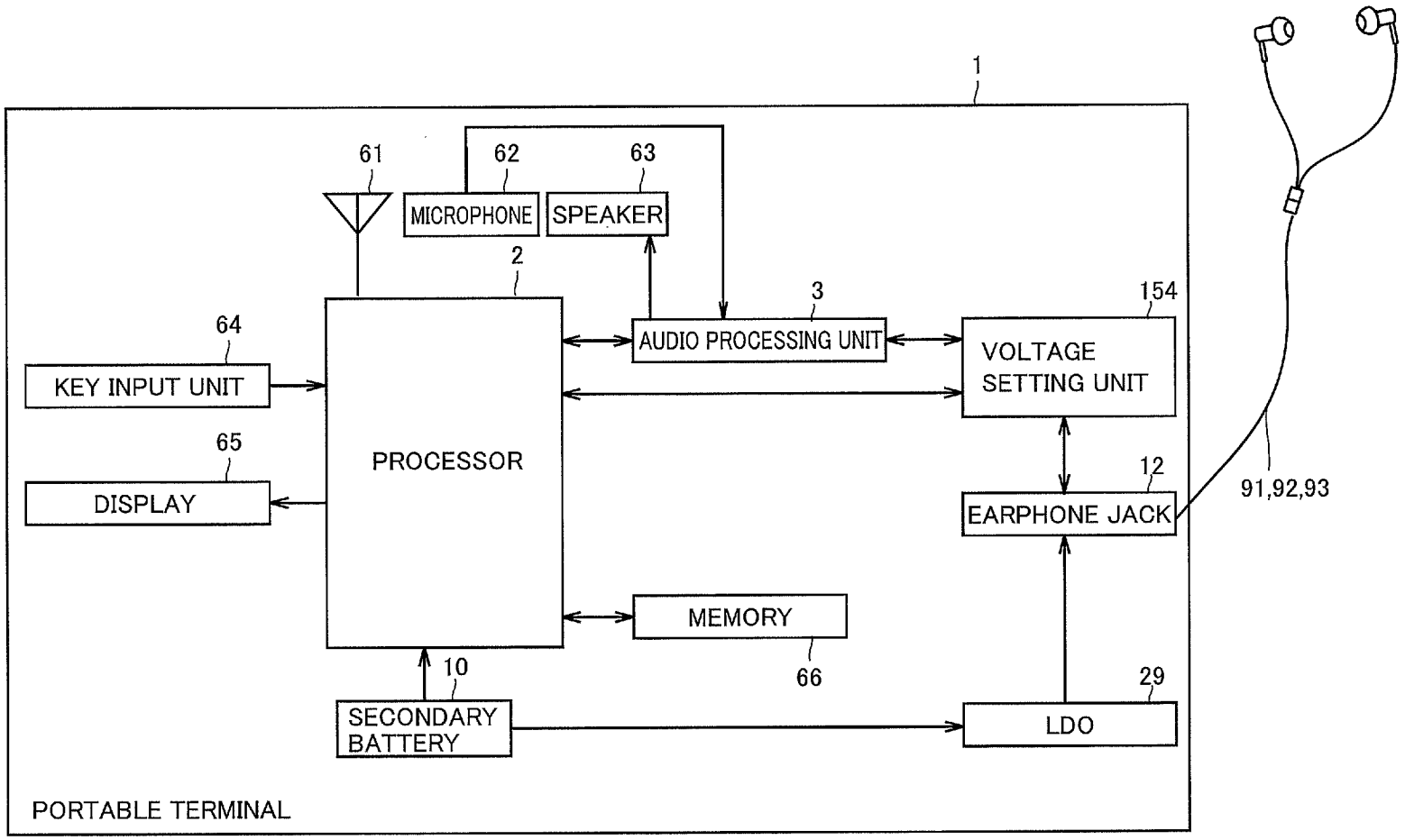
FIG. 1 is a diagram showing a configuration of a portable terminal in an embodiment.

FIG. 1 is a diagram showing a configuration of a portable terminal 1 in an embodiment.

Referring to FIG. 1, portable terminal 1 includes a processor 2, an antenna 61, a microphone 62, a speaker 63, a key input unit 64, a display 65, a memory 66, a secondary battery 10, a low dropout regulator (LDO) 29, a voltage setting unit 154, an audio processing unit 3, and an earphone jack 12.

Earphone jack 12 can be connected to a three-electrode plug earphone 91, a four-electrode plug earphone 92, and a five-electrode plug earphone 93.

Voltage setting unit 154 identifies a state of insertion and removal of earphone 91, 92, or 93 into and from earphone jack 12 and a type of the inserted earphone (three-electrode, four-electrode, or five-electrode), details of which will be described later.

Processor 2 is responsible for overall control. In accordance with various embodiments, processor 2 may be implemented as a single integrated circuit (IC) or as multiple communicatively coupled IC's and/or discrete circuits. Processor 2 can be implemented in accordance with various known technologies. In one embodiment, processor 2 includes one or more circuits or units configurable to perform one or more data computing procedures or processes, for example, by executing instructions stored in an associated memory. In another embodiment, processor 2 may be firmware (such as discrete logic components) configured to perform one or more data computing procedures or processes.

In accordance with various embodiments, processor 2 may include one or more processors, controllers, microprocessors, microcontrollers, application specific integrated circuits (ASICs), digital signal processors, programmable logic devices, field programmable gate arrays, or any combination of these devices or structures, or other known devices and structures, to perform the functions described below.

Antenna 61 can transmit and receive a radio signal to and from a radio base station.

Key input unit 64 can accept an input from a user. In various embodiments, key input unit 64 may be implemented using any input technology or device known in the art such as, for example, a QWERTY keyboard, a pointing device (e.g., a mouse), a joy stick, a stylus, a touch screen display panel, a key pad, one or more buttons, etc., or any combination of these technologies.

Display 65 can show an image sent from processor 2.

Memory 66 can store various types of data.

When an earphone is not inserted in earphone jack 12, audio processing unit 3 can output an audio signal to speaker 63 and can receive an audio signal from microphone 62. When three-electrode plug earphone 91 is inserted in earphone jack 12, audio processing unit 3 can output an audio signal to three-electrode plug earphone 91. When four-electrode plug earphone 92 is inserted in earphone jack 12, audio processing unit 3 can output an audio signal to four-electrode plug earphone 92 and can receive an audio signal from four-electrode plug earphone 92. When five-electrode plug earphone 93 is inserted in earphone jack 12, audio processing unit 3 can output an audio signal to five-electrode plug earphone 93 and can receive an audio signal from five-electrode plug earphone 93.

Microphone 62 can output an input audio signal to audio processing unit 3.

Speaker 63 can reproduce an audio signal sent from audio processing unit 3.

Secondary battery 10 can supply electric power to constituent elements in portable terminal 1.

LDO 29 can prevent a current not lower than a rated current from flowing from secondary battery 10 to earphone 91, 92, or 93.

Secondary battery 10 can supply electric power to five-electrode plug earphone 93 when five-electrode plug earphone 93 is inserted in earphone jack 12.

(Configuration of Earphone)

Figure 2:
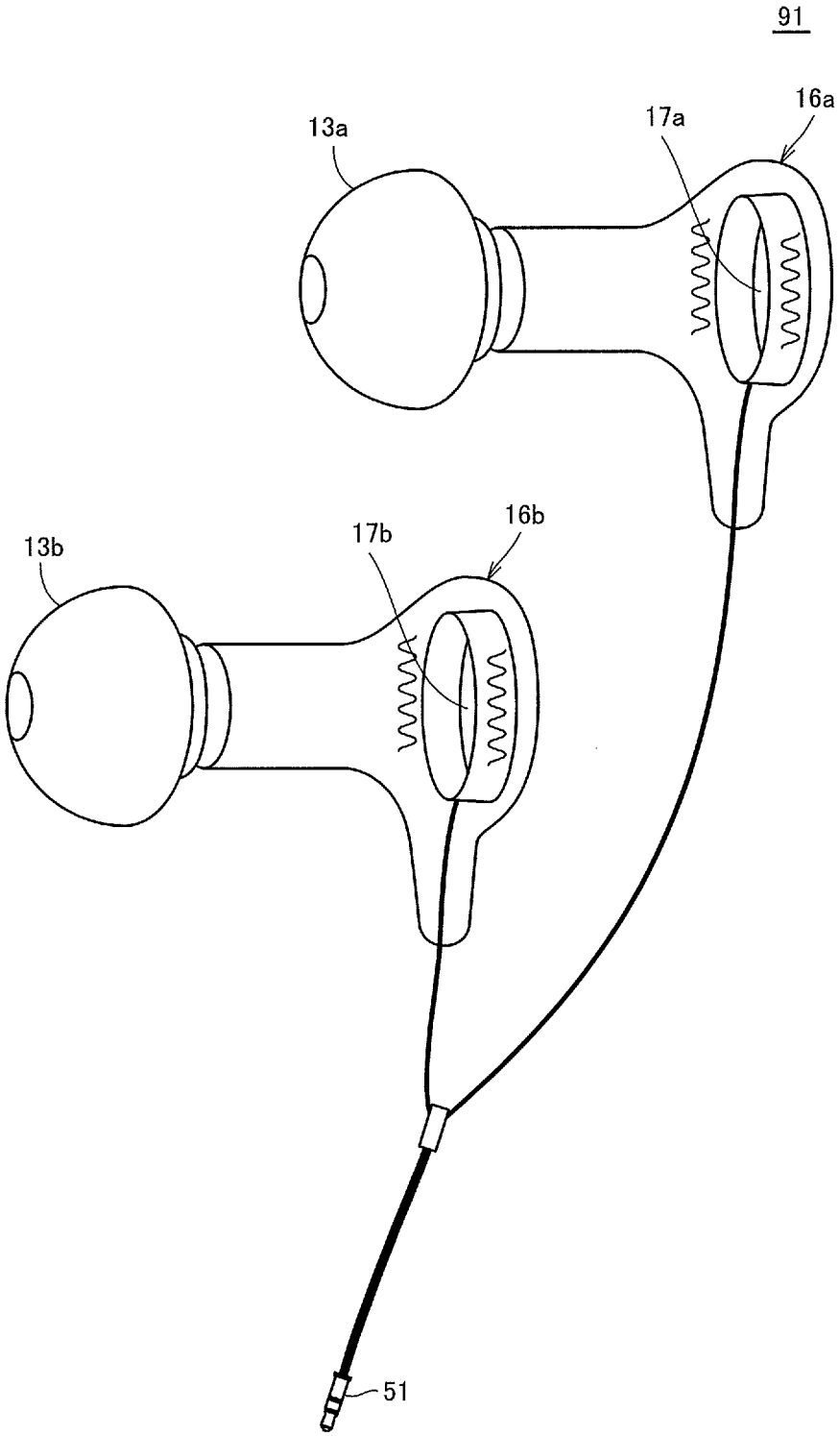
FIG. 2 is a diagram showing a three-electrode plug earphone.

FIG. 2 is a diagram showing three-electrode plug earphone 91.

Three-electrode plug earphone 91 includes a three-electrode plug 51, a silicone cap 13*a*, a housing 16*a*, and a speaker 17*a* for the left ear, and a silicone cap 13*b*, a housing 16*b*, and a speaker 17*b* for the right ear.

Figure 3:
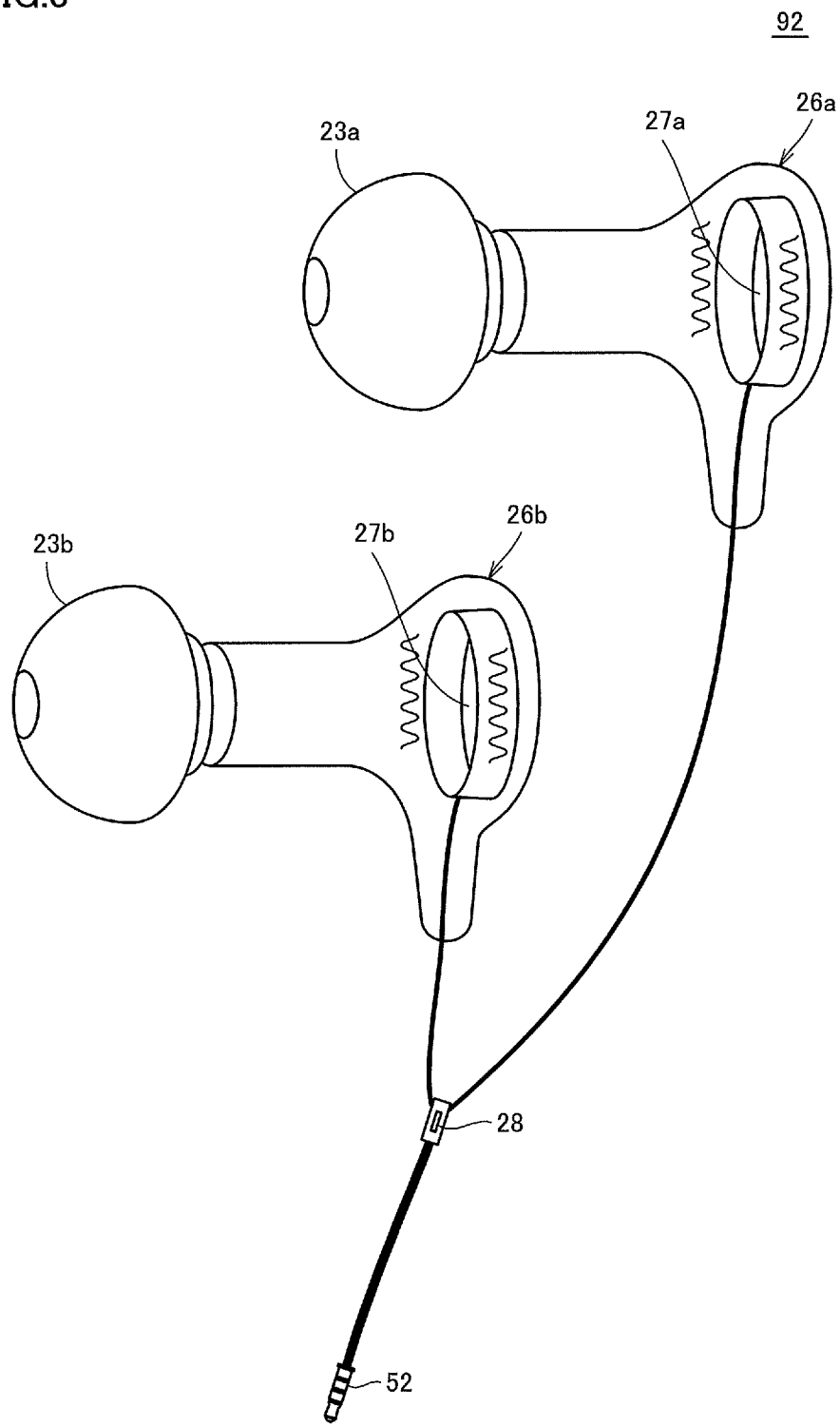
FIG. 3 is a diagram showing a four-electrode plug earphone.

FIG. 3 is a diagram showing four-electrode plug earphone 92.

Four-electrode plug earphone 92 includes a four-electrode plug 52, a microphone 28, a silicone cap 23*a*, a housing 26*a*, and a speaker 27*a* for the left ear, and a silicone cap 23*b*, a housing 26*b*, and a speaker 27*b* for the right ear.

Figure 4:
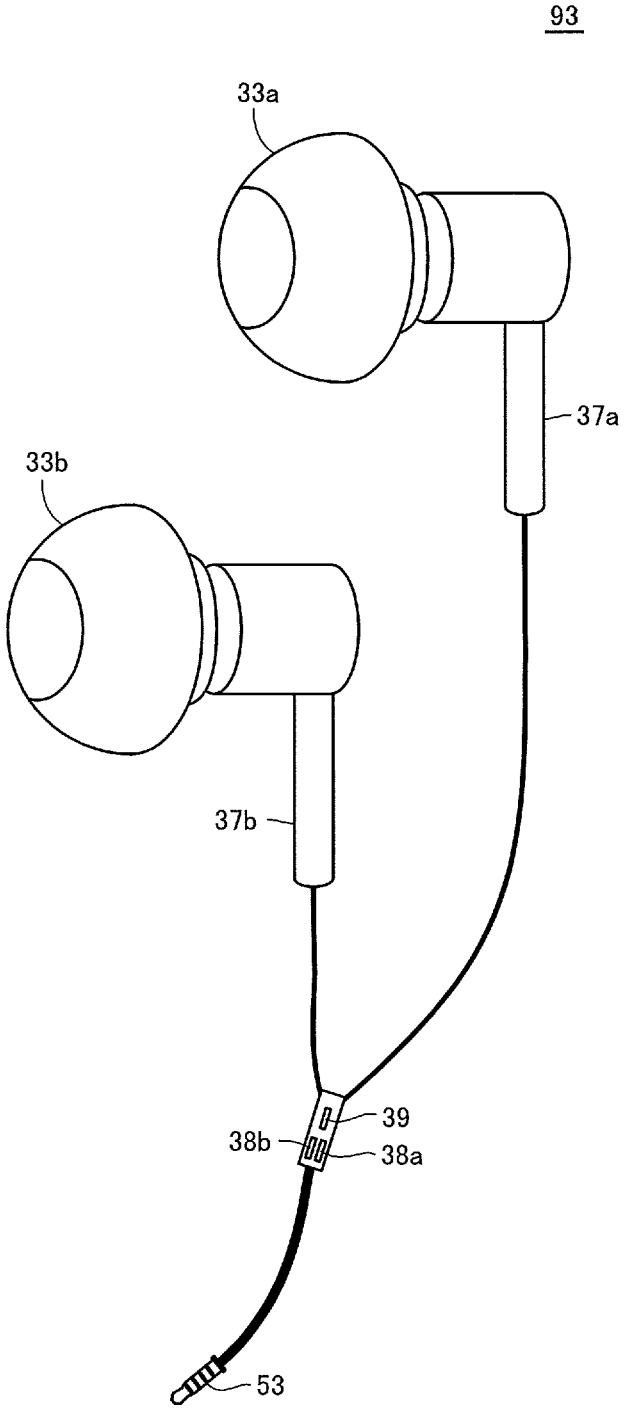
FIG. 4 is a diagram showing a five-electrode plug earphone.

FIG. 4 is a diagram showing five-electrode plug earphone 93.

Five-electrode plug earphone 93 includes a five-electrode plug 53, a microphone 39, a silicone cap 33*a*, a differential amplifier 38*a*, and a piezoelectric element 37*a* for the left ear, and a silicone cap 33*b*, a differential amplifier 38*b*, and a piezoelectric element 37*b* for the right ear.

(Connection Relation Among Constituent Elements in Earphone)

Figure 5:
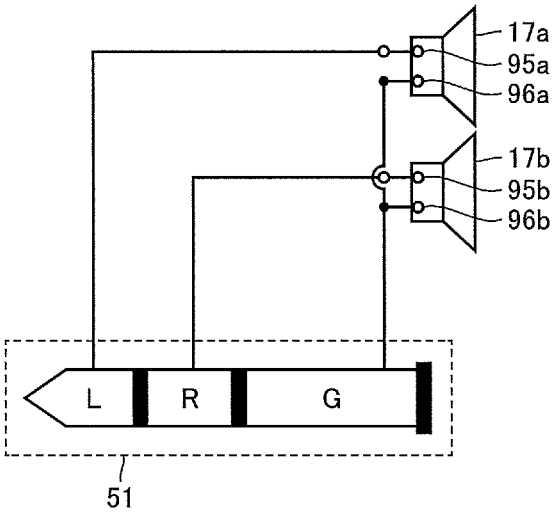
FIG. 5 is a diagram showing connection of constituent elements in the three-electrode plug earphone.

FIG. 5 is a diagram showing connection of constituent elements in three-electrode plug earphone 91.

Three-electrode plug 51 is a plug in conformity with Electronic Industries Association of Japan (EIAJ) standards. Three-electrode plug 51 has a diameter of 3.5 mm. Three-electrode plug 51 includes a left audio terminal (L) (a first terminal), a right audio terminal (R) (a second terminal), and a ground terminal (GND) (a third terminal) sequentially from a tip end. A portion shown with black in FIG. 5 is formed of an insulator.

Speaker 17*a* includes an input terminal 95*a* and a ground voltage input terminal (a ground terminal) 96*a*. Speaker 17*b* includes an input terminal 95*b* and a ground voltage input terminal (a ground terminal) 96*b*.

The left audio terminal (L) can be connected to input terminal 95*a* of speaker 17*a*. The right audio terminal (R) can be connected to input terminal 95*b* of speaker 17*b*. The ground terminal (GND) can be connected to ground terminal 96*a* of speaker 17*a* and ground terminal 96*b* of speaker 17*b*.

Figure 6:
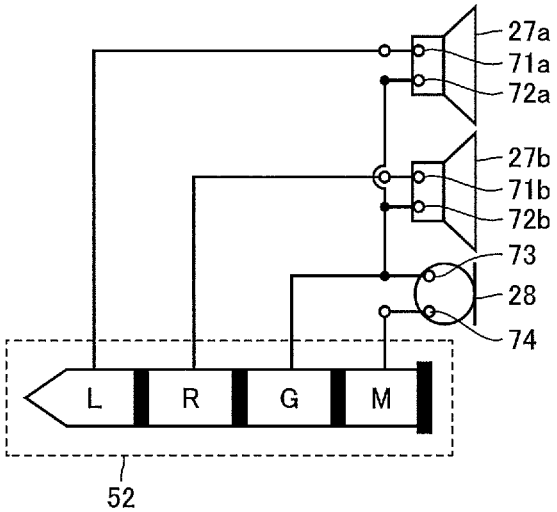
FIG. 6 is a diagram showing connection of constituent elements in the four-electrode plug earphone.

FIG. 6 is a diagram showing connection of constituent elements in four-electrode plug earphone 92.

Four-electrode plug 52 is a plug in conformity with the EIAJ standards. Four-electrode plug 52 has a diameter of 3.5 mm. A signal sequence of four-electrode plug 52 is in conformity with Cellular Telephone Industry Association (CTIA). Four-electrode plug 52 includes a left audio terminal (L) (a first terminal), a right audio terminal (R) (a second terminal), a ground terminal (GND) (a third terminal), and a microphone terminal (M) (a fourth terminal) sequentially from a tip end.

Speaker 27*a* includes an input terminal 71*a* and a ground voltage input terminal (a ground terminal) 72*a*. Speaker 27*b* includes an input terminal 71*b* and a ground voltage input terminal (a ground terminal) 72*b*. Microphone 28 includes an output terminal 74 and a ground voltage input terminal (a ground terminal) 73.

The left audio terminal (L) can be connected to input terminal 71*a* of speaker 27*a*. The right audio terminal (R) can be connected to input terminal 71*b* of speaker 27*b*. The ground terminal (GND) can be connected to ground terminal 72*a* of speaker 27*a*, ground terminal 72*b* of speaker 27*b*, and ground terminal 73 of microphone 28. The microphone terminal (M) can be connected to output terminal 74 of microphone 28.

Figure 7:
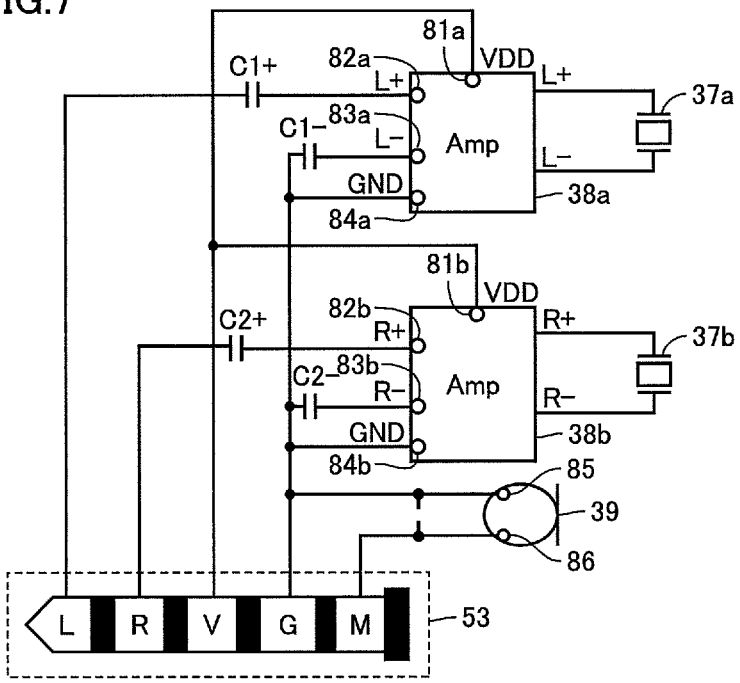
FIG. 7 is a diagram showing connection of constituent elements in the five-electrode plug earphone.

FIG. 7 is a diagram showing connection of constituent elements in five-electrode plug earphone 93.

Five-electrode plug 53 includes a left audio terminal (L) (a first terminal), a right audio terminal (R) (a second terminal), a power supply terminal (V) (a third terminal), a ground terminal (GND) (a fourth terminal), and a microphone terminal (M) (a fifth terminal) sequentially from a tip end.

Differential amplifier 38*a* includes a positive-side input terminal 82*a*, a negative-side input terminal 83*a*, a power supply voltage input terminal (a power supply terminal) 81*a*, and a ground voltage input terminal (a ground terminal) 84*a*. Differential amplifier 38*b* includes a positive-side input terminal 82*b*, a negative-side input terminal 83*b*, a power supply voltage input terminal (a power supply terminal) 81*b*, and a ground voltage input terminal (a ground terminal) 84*b*. Microphone 39 includes an output terminal 86 and a ground voltage input terminal (a ground terminal) 85.

The left audio terminal (L) can be connected to positive-side input terminal 82*a* of differential amplifier 38*a* with a capacitor C1+ (=0.1 μF) being interposed. The right audio terminal (R) can be connected to positive-side input terminal 82*b* of differential amplifier 38*b* with a capacitor C2+ (=0.1 μF) being interposed. The power supply terminal (V) can be connected to power supply terminal 81*a* of differential amplifier 38*a* and power supply terminal 81*b* of differential amplifier 38*b*. The ground terminal (GND) can be connected to negative-side input terminal 83*a* of differential amplifier 38*a* with a capacitor C1− (=0.1 μF) being interposed. The ground terminal (GND) can further be connected to ground terminal 84*a* of differential amplifier 38*a*. The ground terminal (GND) can be connected to negative-side input terminal 83*b* of differential amplifier 38*b* with capacitor C2− (=0.1 μF) being interposed. The ground terminal (GND) can further be connected to ground terminal 84*b* of differential amplifier 38*b*. The ground terminal (GND) can further be connected to ground terminal 85 of microphone 39. The microphone terminal (M) can be connected to output terminal 86 of microphone 39.

Differential amplifier 38*a* can amplify a difference between a voltage of positive-side input terminal 82*a* and a voltage of negative-side input terminal 83*a* and supply a voltage (L+, L−) to piezoelectric element 37*a*. Piezoelectric element 37*a* oscillates in accordance with magnitude of the supplied voltage. Differential amplifier 38*b* amplifies a difference between a voltage of positive-side input terminal 82*b* and a voltage of negative-side input terminal 83*b* and supply a voltage (R+, R−) to piezoelectric element 37*b*. Piezoelectric element 37*b* can oscillate in accordance with magnitude of the supplied voltage. To differential amplifiers 38*a* and 38*b*, 5 to 30 Vpp (that is, a difference in potential between a maximum value and a minimum value of an alternating-current voltage waveform being from 5 to 30 V) is applied, and therefore an efficient class D or class H amplifier can be used.

The reason why differential amplifiers 38*a* and 38*b* are necessary is that piezoelectric elements 37*a* and 37*b* are driven by an input signal at a high voltage.

If differential amplifiers 38*a* and 38*b* are located on a side of portable terminal 1, in order to supply a voltage output from differential amplifiers 38*a* and 38*b* to piezoelectric elements 37*a* and 37*b*, a plug requires four terminals for outputting voltages (L+, L−, R+, R−). Consequently, the plug is a six-electrode plug with the ground terminal (GND) and the microphone terminal (M) being added, and an earphone jack which can adapt to the six-electrode plug is required also on the side of the portable terminal.

A configuration allowing connection of all of the three-electrode plug, the four-electrode plug, and the six-electrode plug with an earphone jack which can adapt to the six-electrode plug is complicated or difficult. Therefore, in an embodiment, an earphone including a five-electrode plug is employed and differential amplifiers 38*a* and 38*b* are located on a side of the earphone.

(Positional Relation Between Terminals of Earphone Jack and Terminals in Three-Electrode, Four-Electrode, and Five-Electrode Plugs)

Figure 8A:
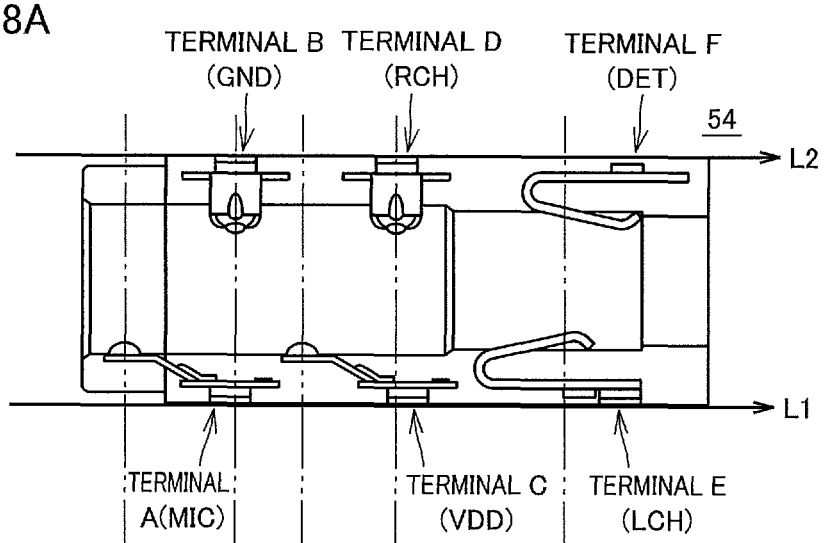
FIG. 8A is a diagram showing an earphone jack.

FIG. 8A is a diagram showing an earphone jack 54.

Earphone jack 54 includes a terminal A (MIC) (a first terminal), a terminal B (GND) (a second terminal), a terminal C (VDD) (a third terminal), a terminal D (Rch) (a fourth terminal), a terminal E (Lch) (a fifth terminal), and a terminal F (DET) (a sixth terminal) in the order of proximity to an insertion port.

The terminal A (MIC) (the first terminal), the terminal C (VDD) (the third terminal), and the terminal E (Lch) (the fifth terminal) can be arranged along a first line L1 in parallel to a direction of insertion over a cylindrical inner wall of earphone jack 54.

The terminal B (GND) (the second terminal), the terminal D (Rch) (the fourth terminal), and the terminal F (DET) (the sixth terminal) can be arranged along a second line L2 in parallel to the direction of insertion over the cylindrical inner wall of earphone jack 54 and opposed to first line L1.

Figure 8B:
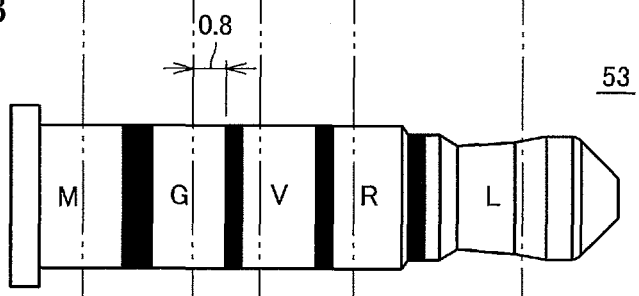
FIG. 8B is a diagram showing a five-electrode plug.

FIG. 8B is a diagram showing five-electrode plug 53.

Five-electrode plug 53 can be connected to earphone jack 54 as below when it is completely inserted into earphone jack 54.

The left audio terminal (L) can be connected to the terminal E (Lch) and the terminal F (DET). The right audio terminal (R) is connected to the terminal D (Rch). The power supply terminal (V) can be connected to the terminal C (VDD). The ground terminal (G) is connected to the terminal B (GND). The microphone terminal (M) can be connected to the terminal A (MIC).

Figure 8C:
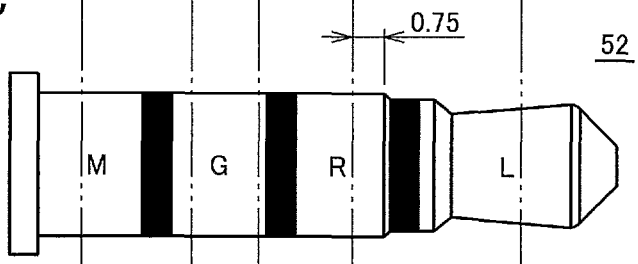
FIG. 8C is a diagram showing a four-electrode plug.

FIG. 8C is a diagram showing four-electrode plug 52.

Four-electrode plug 52 can be connected to earphone jack 54 as below when it is completely inserted into earphone jack 54.

The left audio terminal (L) can be connected to the terminal E (Lch) and the terminal F (DET). The right audio terminal (R) can be connected to the terminal D (Rch). The ground terminal (G) can be connected to the terminal B (GND) and the terminal C (VDD). The microphone terminal (M) can be connected to the terminal A (MIC).

Figure 8D:
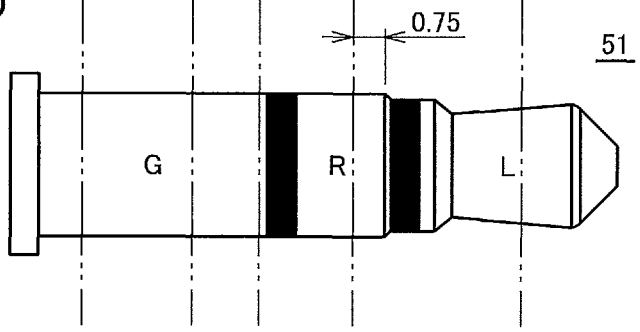
FIG. 8D is a diagram showing a three-electrode plug.

FIG. 8D is a diagram showing three-electrode plug 51.

Three-electrode plug 51 can be connected to earphone jack 54 as below when it is completely inserted into earphone jack 54.

The left audio terminal (L) can be connected to the terminal E (Lch) and the terminal F (DET). The right audio terminal (R) can be connected to the terminal D (Rch). The ground terminal (G) can be connected to the terminal A (MIC), the terminal B (GND), and the terminal C (VDD).

(Configuration for Transmission and Reception of Signal to and from Earphone)

Figure 9:
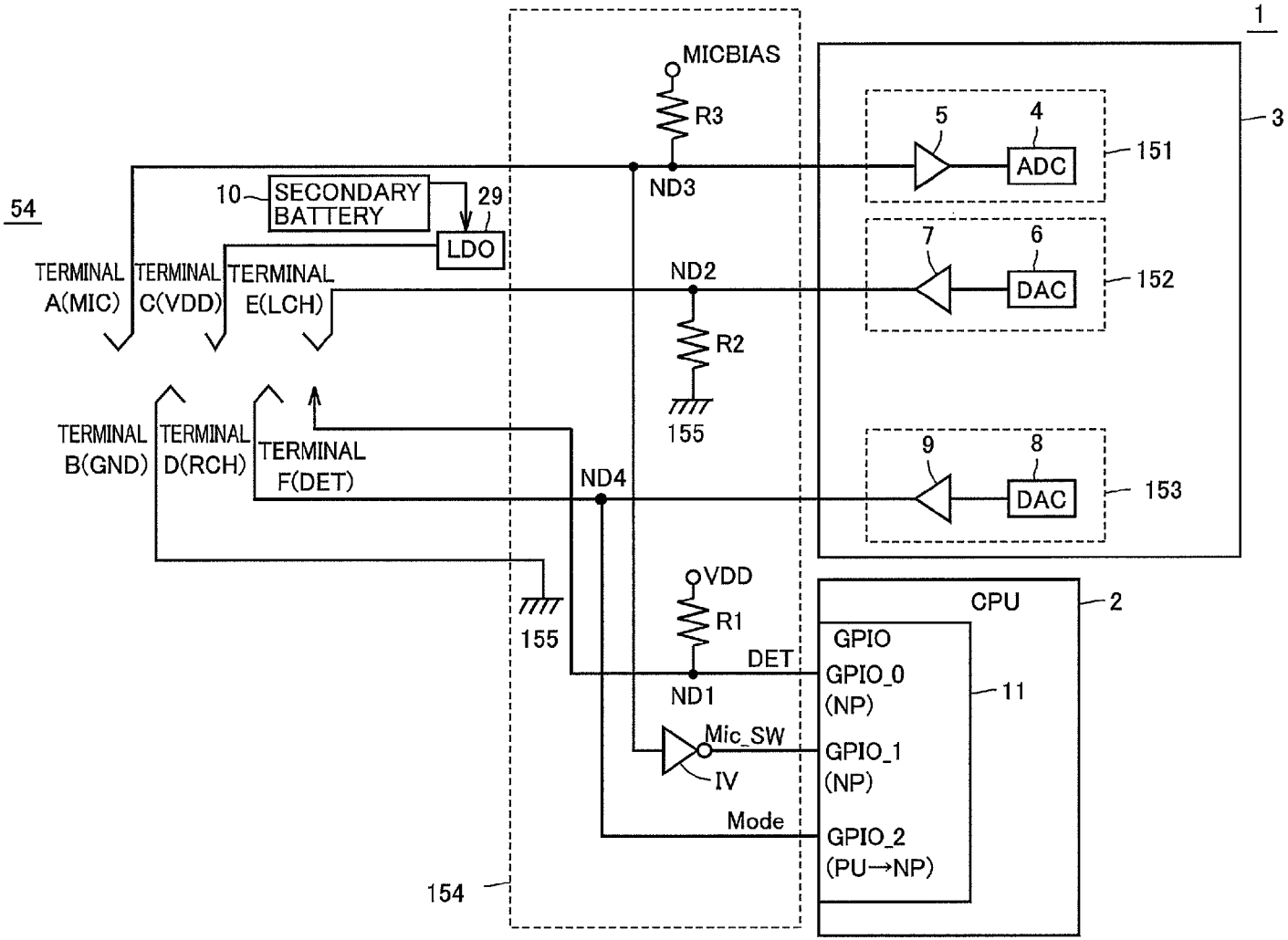
FIG. 9 is a diagram showing a configuration associated with transmission and reception of a signal to and from an earphone.

FIG. 9 is a diagram showing a configuration associated with transmission and reception of a signal to and from an earphone in portable terminal 1.

Audio processing unit 3 includes a microphone audio processing unit 151, an audio output unit 152, and an audio output unit 153.

Microphone audio processing unit 151 includes an amplifier 5 and an AD converter 4. Amplifier 5 can be connected to the terminal A (MIC) of earphone jack 54. Amplifier 5 can amplify an audio signal output from the terminal A (MIC). AD converter 4 can convert an audio signal output from amplifier 5 into a digital signal.

Audio output unit 152 includes a DA converter 6 and an amplifier 7. DA converter 6 can convert a digital audio signal for the left ear into an analog audio signal. Amplifier 7 can amplify or attenuate an audio signal output from DA converter 6. Amplifier 7 can be connected to the terminal E (Lch) of earphone jack 54.

Audio output unit 153 includes a DA converter 8 and an amplifier 9. DA converter 8 can convert a digital audio signal for the right ear into an analog audio signal. Amplifier 9 can amplify or attenuate an audio signal output from DA converter 8. Amplifier 9 can be connected to the terminal D (Rch) of earphone jack 54.

Voltage setting unit 154 includes a pull-up resistor R1, a pull-down resistor R2, a pull-up resistor R3, an inverter IV, and a ground 155.

Pull-up resistor R1 can be connected between a node ND1 on a line between the terminal F (DET) of earphone jack 54 and processor 2 and a power supply voltage VDD for pull-up.

Pull-down resistor R2 can be connected between a node ND2 on a line between the terminal E (Lch) of earphone jack 54 and audio output unit 152 and ground 155.

Pull-up resistor R3 can be connected between a node ND3 on a line between the terminal A (MIC) of earphone jack 54 and microphone audio processing unit 151 and a bias voltage MICBIAS for pull-up.

Inverter IV can invert a voltage of node ND3.

Ground 155 can be connected to the terminal B (GND) of earphone jack 54.

Processor 2 includes a general purpose input/output (GPIO) interface 11.

GPIO interface 11 includes terminals GPIO_0, GPIO_1, and GPIO_2. GPIO interface 11 can switch an input terminal among terminals GPIO_0, GPIO_1, and GPIO_2 and can switch an output terminal among terminals GPIO_0, GPIO_1, and GPIO_2. At the time of input, in the terminal, pull-up (PU) at several hundred kΩ to the power supply, pull-down (PD) at several hundred Ω to the ground, or neither of pull-up and pull-down (NP) can be set.

Terminal GPIO_0 can be connected to node ND1. Processor 2 can control pull-up of an output from terminal GPIO_0. Processor 2 can receive a detection signal DET input to terminal GPIO_0.

Terminal GPIO_1 can be connected to an output of inverter IV. Processor 2 can control pull-up of an output from terminal GPIO_1. Processor 2 can receive a signal MIC_SW input to terminal GPIO_1.

Terminal GPIO_2 can be connected to a node ND4 on a line between the terminal D (Rch) of earphone jack 54 and audio output unit 153. Processor 2 controls pull-up of an output from terminal GPIO_2. Processor 2 can receive a mode signal Mode input to terminal GPIO_2.

LDO 29 can be connected to the terminal C (VDD) of earphone jack 54.

Figure 10:
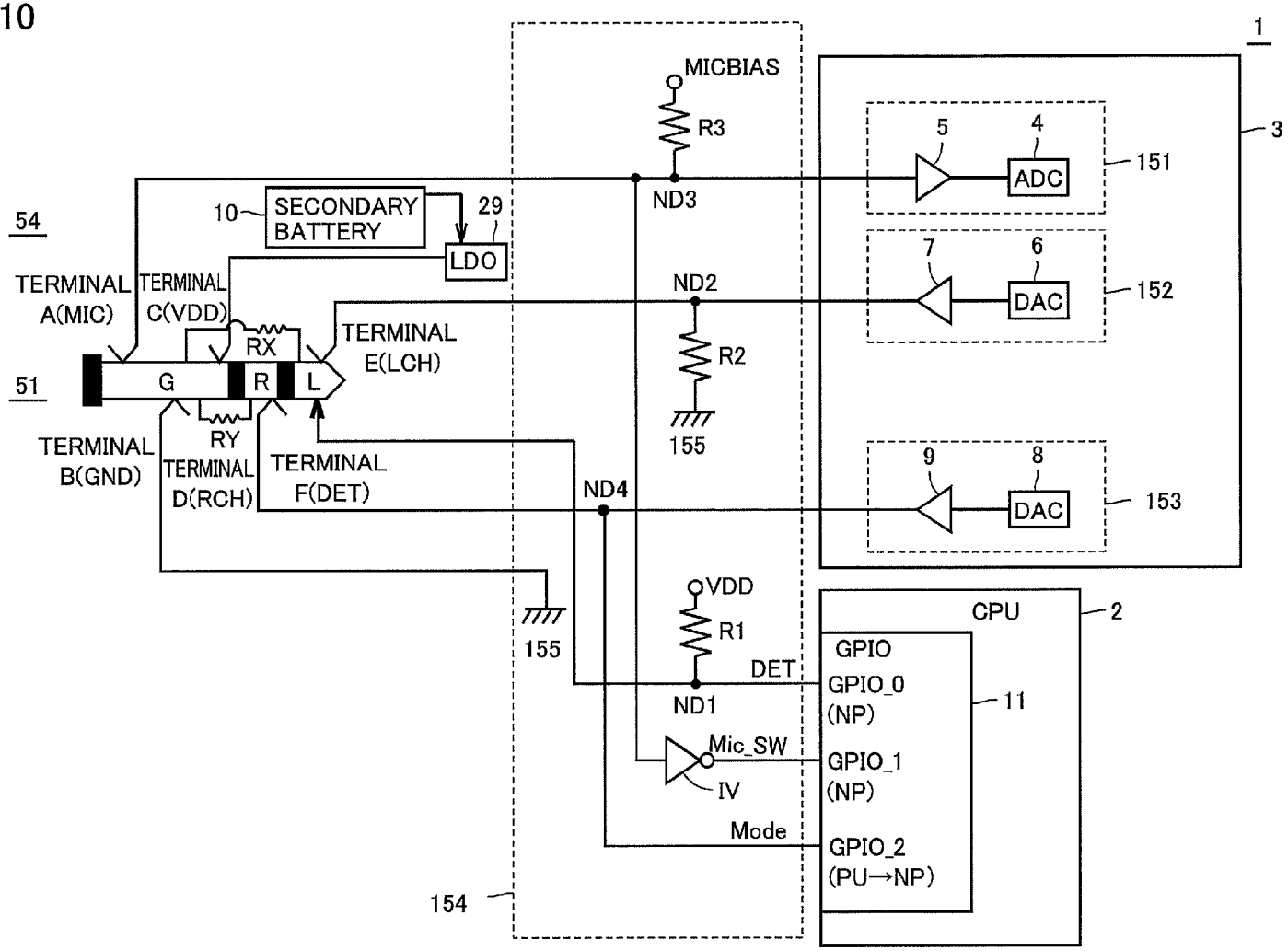
FIG. 10 is a diagram showing connection between the three-electrode plug earphone and constituent elements in the portable terminal when a three-electrode plug is inserted in the earphone jack.

FIG. 10 is a diagram showing connection between three-electrode plug earphone 91 and constituent elements in portable terminal 1 when three-electrode plug 51 is inserted into earphone jack 54.

Speaker 17*a* connected between the left audio terminal (L) and the ground terminal (G) of three-electrode plug 51 can be expressed as a resistor RX (=8Ω) when expressed as an equalization circuit. Speaker 17*b* connected between the right audio terminal (R) and the ground terminal (G) of three-electrode plug 51 can be expressed as a resistor RY (=8Ω) when expressed as an equalization circuit.

Figure 11:
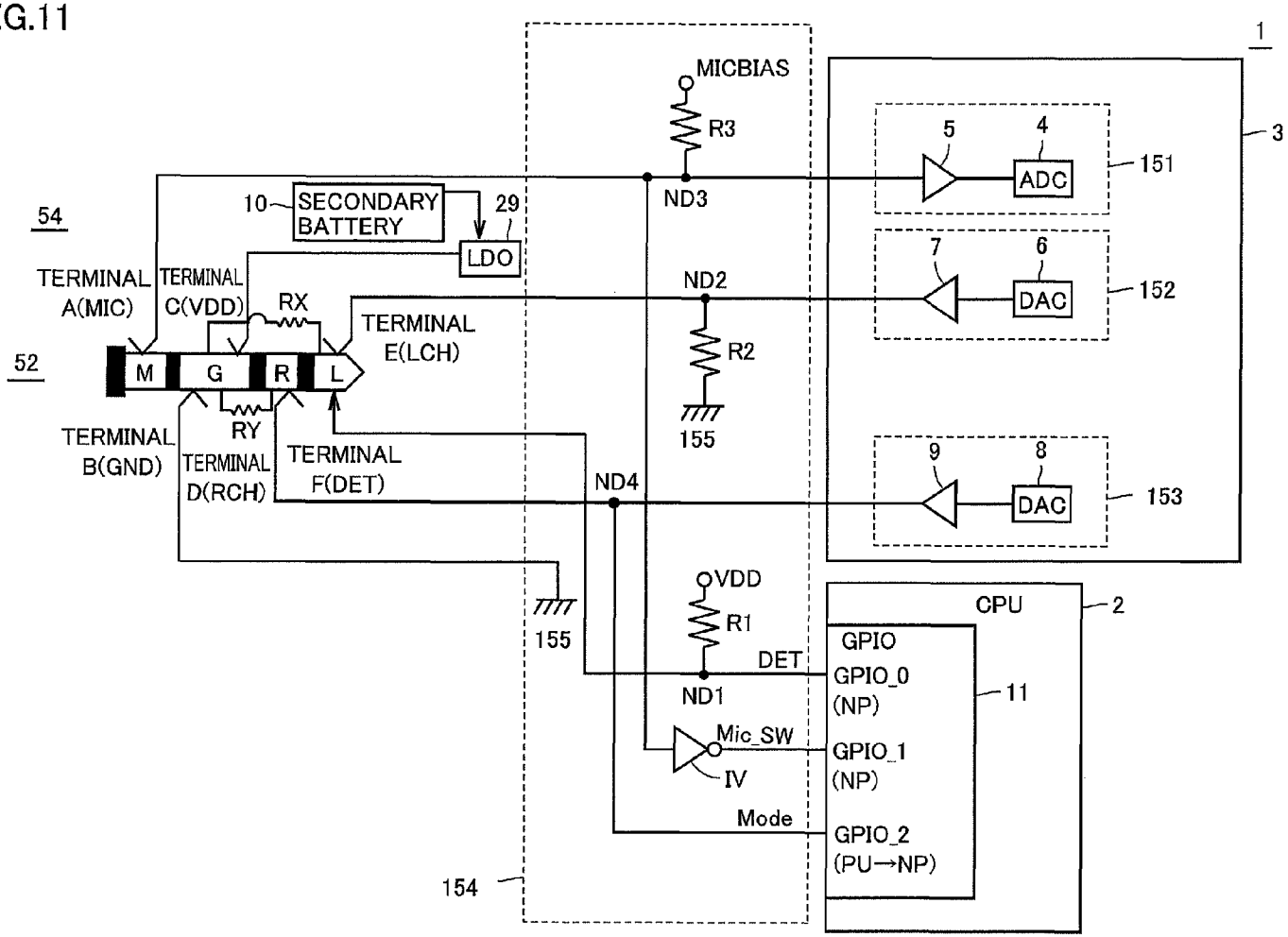
FIG. 11 is a diagram showing connection between the four-electrode plug earphone and constituent elements in the portable terminal when a four-electrode plug is inserted in the earphone jack.

FIG. 11 is a diagram showing connection between four-electrode plug earphone 92 and constituent elements in portable terminal 1 when four-electrode plug 52 is inserted into earphone jack 54.

Speaker 27*a* connected between the left audio terminal (L) and the ground terminal (G) of four-electrode plug 52 can be expressed as resistor RX (=8Ω) when expressed as an equalization circuit. Speaker 27*b* connected between the right audio terminal (R) and the ground terminal (G) of four-electrode plug 52 can be expressed as resistor RY (=8Ω) when expressed as an equalization circuit.

Figure 12:
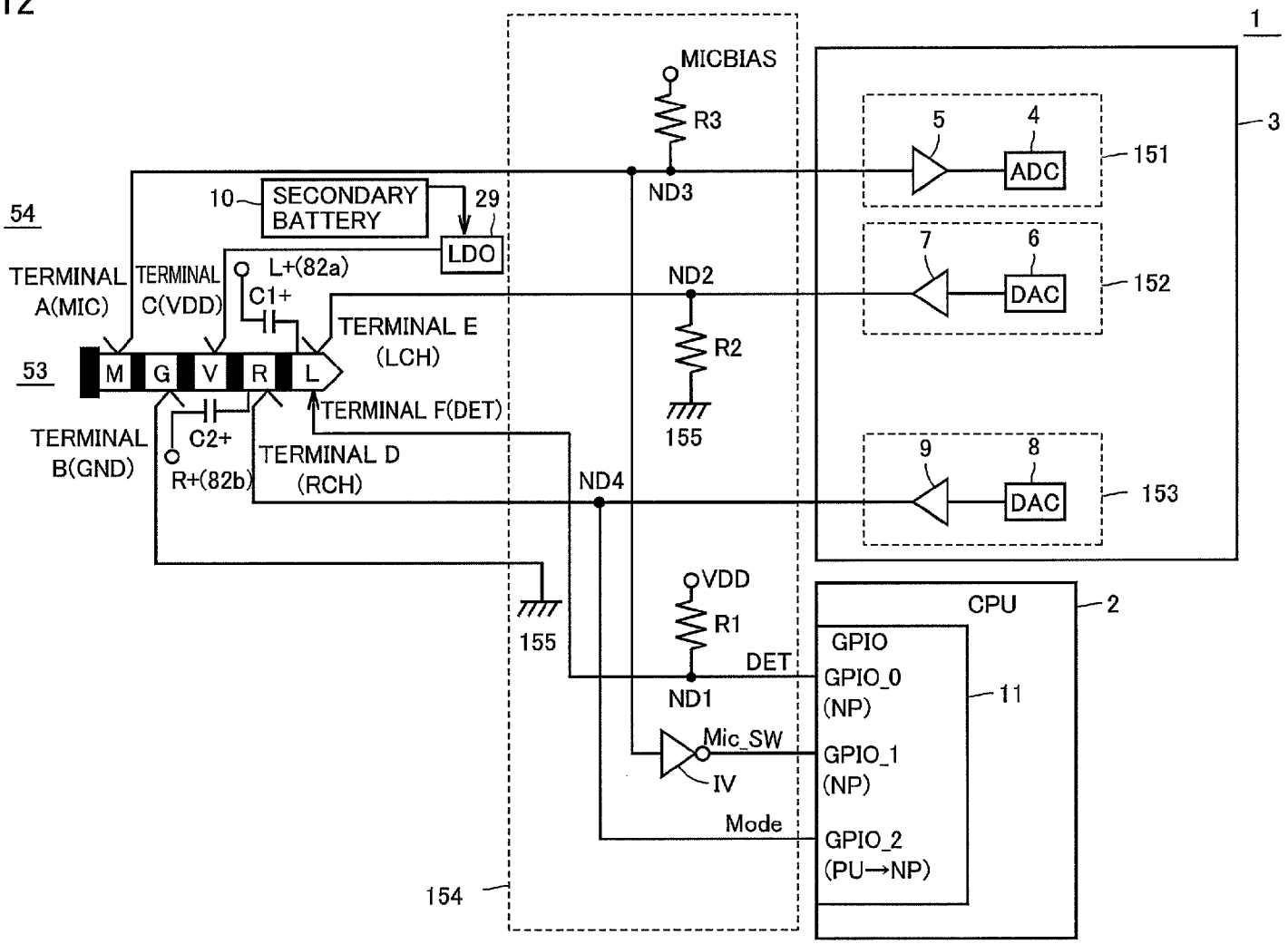
FIG. 12 is a diagram showing connection between the five-electrode plug earphone and constituent elements in the portable terminal when a five-electrode plug is inserted in the earphone jack.

FIG. 12 is a diagram showing connection between five-electrode plug earphone 93 and constituent elements in portable terminal 1 when five-electrode plug 53 is inserted into earphone jack 54.

The left audio terminal (L) of five-electrode plug 53 can be connected to positive-side input terminal 82*a* of differential amplifier 38*a* with capacitor C1+ being interposed. The right audio terminal (R) of five-electrode plug 53 can be connected to positive-side input terminal 82*b* of differential amplifier 38*b* with capacitor C2+ being interposed. Therefore, the left audio terminal (L) and the right audio terminal (R) of five-electrode plug 53 can be isolated in a direct-current state.

(Determination of Insertion and Removal of Plug and Identification of Type of Plug)

Figure 13:
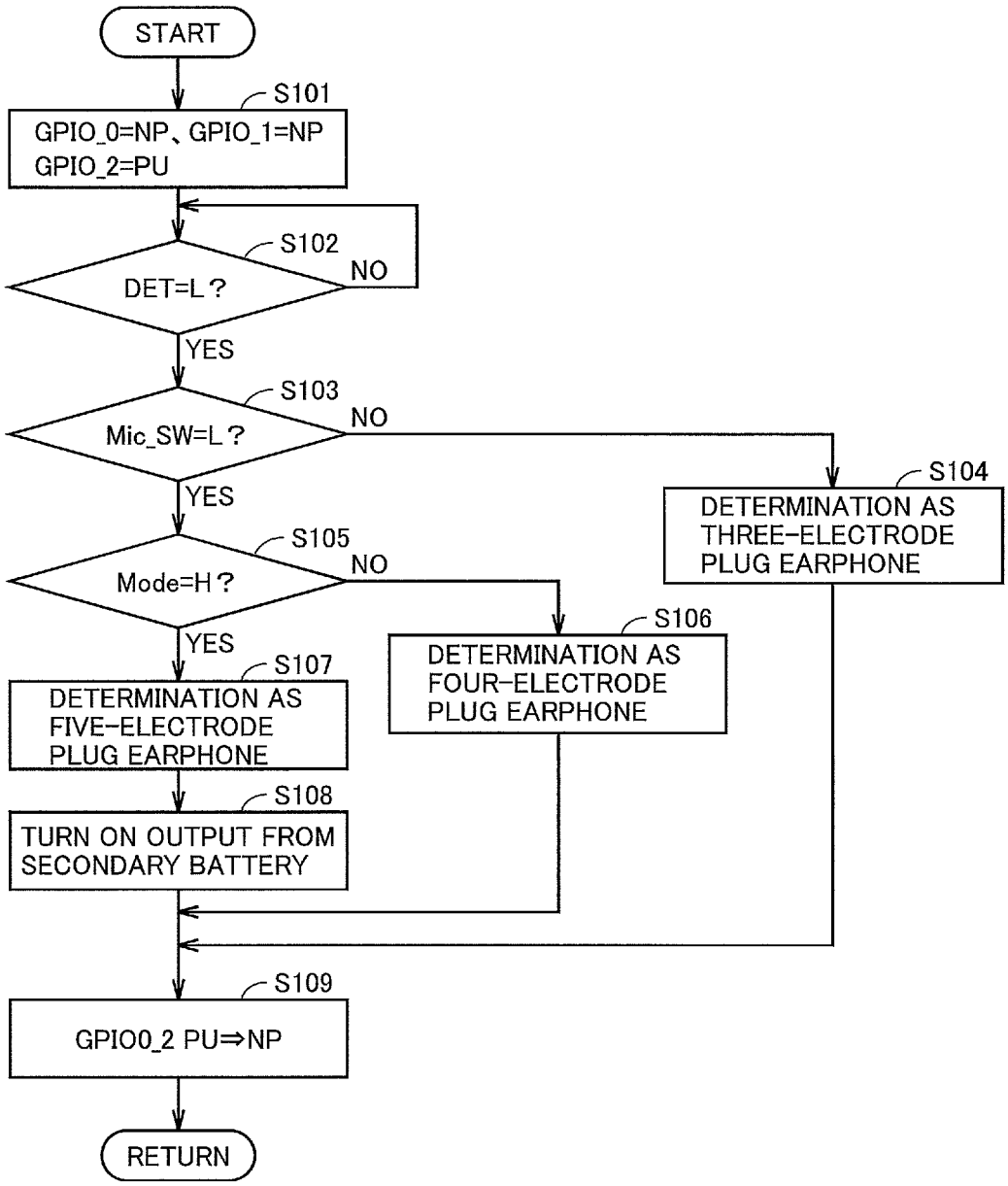
FIG. 13 is a flowchart showing a procedure for determining insertion and removal of a plug and for identifying a type of a plug.

FIG. 13 is a flowchart showing a procedure for determining insertion and removal of a plug and for identifying a type of a plug.

Referring to FIGS. 9 to 13, in step S101, processor 2 can pull up GPIO_2 (PU) without pulling up GPIO_0 and GPIO_1 of GPIO interface 11 (NP).

As shown in FIG. 9, when a plug is not inserted in earphone jack 54, a voltage of detection node ND1 is pulled up by resistor R1 (=100 kΩ) connected to power supply voltage VDD and can attain to the high level (H). Consequently, detection signal DET input to GPIO_0 can attain to the high level (H).

As shown in FIGS. 10 and 11, when plug 51 or 52 is inserted in earphone jack 54, node ND1 can be connected to pull-up resistor R1 (=100 kΩ) connected to power supply voltage VDD, pull-down resistor R2 (=10 kΩ) connected to the ground, and resistor RX (=8Ω) connected to the ground. Consequently, a voltage of node ND1 attains to the low level (L) and detection signal DET input to GPIO_0 can attain to the low level (L).

As shown in FIG. 12, when plug 53 is inserted in earphone jack 54, node ND1 can be connected to pull-up resistor R1 (=100 kΩ) connected to power supply voltage VDD, pull-down resistor R2 (=10 kΩ) connected to the ground, and capacitor C1+ (=0.1 μF) which is in a direct-current floating state. Consequently, a voltage of node ND1 attains to the low level (L) and detection signal DET input to GPIO_0 can attain to the low level (L).

In step S102, processor 2 determines that the plug has been inserted in earphone jack 54 when detection signal DET is at the low level (L), and the process proceeds to step S103.

As shown in FIG. 10, node ND3 can be connected to pull-up resistor R3 (=2.2 kΩ) connected to bias voltage MICBIAS. When three-electrode plug 51 is connected to earphone jack 54, node ND3 is further connected to the ground terminal (G) and hence it can attain to the low level (L). Consequently, output from inverter IV connected to node ND3 attains to the high level (H) and signal Mic_SW input to GPIO_1 can attain to the high level (H).

As shown in FIGS. 11 and 12, when four-electrode plug 52 or five-electrode plug 53 is connected to earphone jack 54, node ND3 can be connected to the microphone terminal (M). Since the microphone terminal (M) outputs a positive signal, node ND3 can attain to the high level (H). Consequently, output from inverter IV connected to node ND3 can attain to the low level (L) and signal Mic_SW input to GPIO_1 can attain to the high level (H).

In step S103, processor 2 allows the process to proceed to step S104 when signal Mic_SW is at the high level (H) and allows the process to proceed to step S105 when signal Mic_SW is at the low level (L).

In step S104, processor 2 determines that the inserted plug is three-electrode plug 51.

As shown in FIG. 11, as GPIO_2 is pulled up in step S101, node ND4 can be pulled up. When four-electrode plug 52 is connected to earphone jack 54, node ND4 can further be connected to resistor RY (=8Ω) connected to the ground. Consequently, node ND4 attains to the low level and mode signal Mode input to GPIO_2 can attain to the low level.

As shown in FIG. 12, when five-electrode plug 53 is connected to earphone jack 54, node ND4 can further be connected to capacitor C2+ (=0.1 μF) isolated when a direct current flows. Consequently, node ND4 can maintain the high level and mode signal Mode input to GPIO_2 can attain to the high level.

In step S105, processor 2 allows the process to proceed to step S106 when mode signal Mode is at the low level (L) and allows the process to proceed to step S107 when mode signal Mode is at the high level (H).

In step S106, processor 2 can determine that the inserted plug is four-electrode plug 52.

In step S107, processor 2 can determine that the inserted plug is five-electrode plug 53.

In step S108, processor 2 can start supply of power supply voltage VDD from secondary battery 10 through LDO 29 to earphone jack 54.

In step S109, processor 2 can cancel pull-up of GPIO_2 (NP). Thus, for use as terminal RCH, the right audio terminal (R) and the terminal Decan be used for transmission of an audio signal for the right ear.

(Process of Insertion of Plug into Earphone Jack)

Connection between terminals in a process of insertion of five-electrode plug 53 into earphone jack 54 will now be described.

FIGS. 14A to 14E are diagrams showing a Stage 1 to a Stage 5 in a process of insertion of five-electrode plug 53 into earphone jack 54, respectively.

Figure 14A:
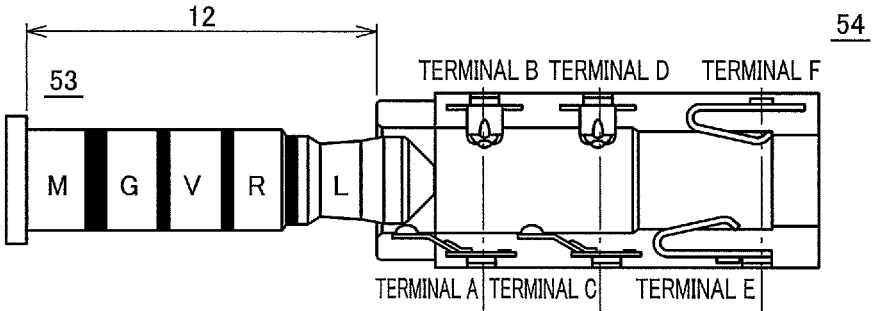
FIGS. 14A to 14E are diagrams showing a Stage 1, a Stage 2, a Stage 3, a Stage 4, and a Stage 5 in a process of insertion of the five-electrode plug into the earphone jack, respectively.

As shown in FIG. 14A, in Stage 1, the left audio terminal (L) of five-electrode plug 53 can be connected to the terminal A (MIC) of earphone jack 54.

Figure 14B:
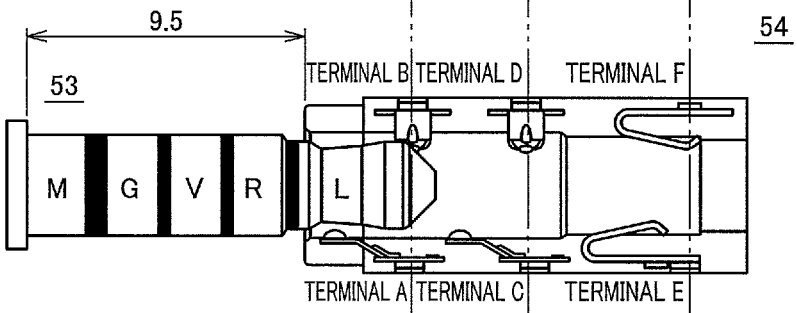

As shown in FIG. 14B, in Stage 2, the left audio terminal (L) of five-electrode plug 53 can be connected to the terminal B (GND) of earphone jack 54.

Figure 14C:
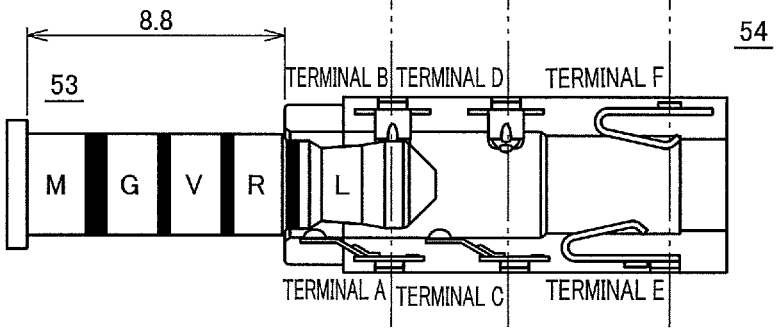

As shown in FIG. 14C, in Stage 3, the left audio terminal (L) of five-electrode plug 53 can be connected to the terminal A (MIC) and the terminal B (GND) of earphone jack 54.

Figure 14D:
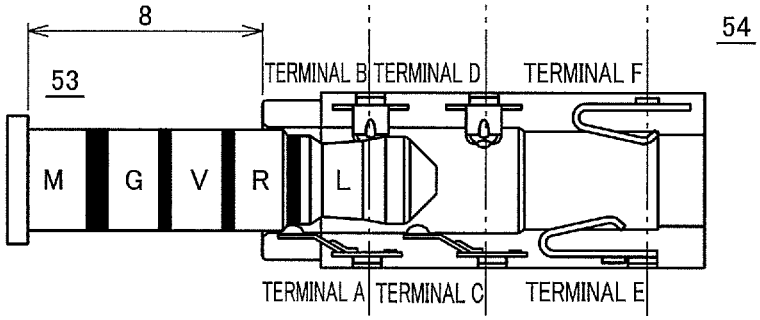

As shown in FIG. 14D, in Stage 4, the left audio terminal (L) of five-electrode plug 53 can be connected to the terminal B (GND) of earphone jack 54 and the right audio terminal (R) of five-electrode plug 53 can be connected to the terminal A (MIC) of earphone jack 54.

Figure 14E:
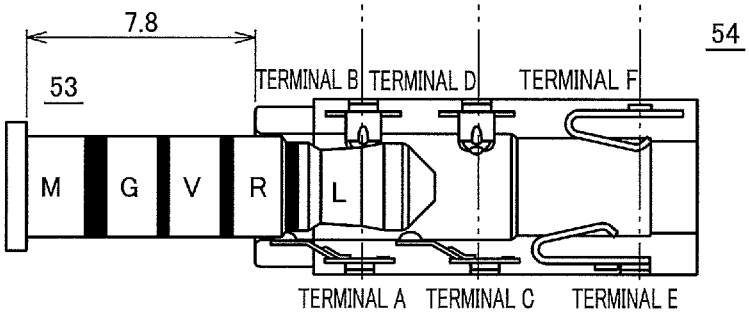

As shown in FIG. 14E, in Stage 5, the left audio terminal (L) of five-electrode plug 53 can be connected to the terminal B (GND) and the terminal C (VDD) of earphone jack 54, and the right audio terminal (R) of five-electrode plug 53 can be connected to the terminal A (MIC) of earphone jack 54.

FIGS. 15A to 15E are diagrams showing a Stage 6 to a Stage 10 in the process of insertion of five-electrode plug 53 into earphone jack 54, respectively.

Figure 15A:
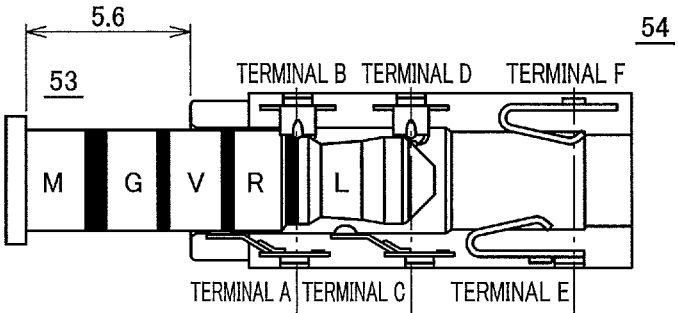
FIGS. 15A to 15E are diagrams showing a Stage 6, a Stage 7, a Stage 8, a Stage 9, and a Stage 10 in the process of insertion of the five-electrode plug into the earphone jack, respectively.

As shown in FIG. 15A, in Stage 6, the left audio terminal (L) of five-electrode plug 53 can be connected to the terminal B (GND) of earphone jack 54 and the power supply terminal (V) of five-electrode plug 53 can be connected to the terminal A (MIC) of earphone jack 54.

Figure 15B:
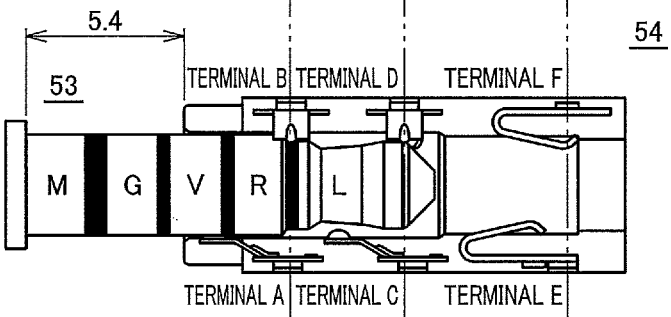

As shown in FIG. 15B, in Stage 7, the left audio terminal (L) of five-electrode plug 53 can be connected to the terminal D (Rch) of earphone jack 54, the right audio terminal (R) of five-electrode plug 53 can be connected to the terminal B (GND) of earphone jack 54, and the power supply terminal (V) of five-electrode plug 53 can be connected to the terminal A (MIC) of earphone jack 54.

Figure 15C:
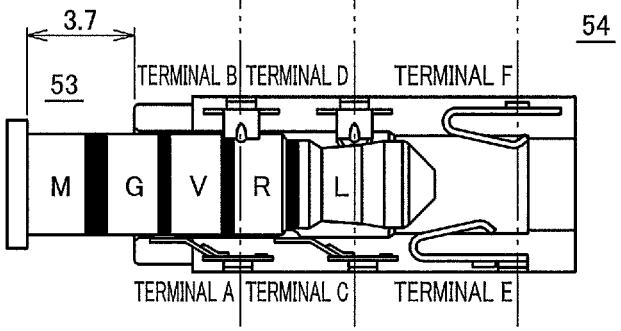

As shown in FIG. 15C, in Stage 8, the left audio terminal (L) of five-electrode plug 53 can be connected to the terminal D (Rch) of earphone jack 54 and the right audio terminal (R) of five-electrode plug 53 can be connected to the terminal B (GND) and the terminal C (VDD) of earphone jack 54.

Figure 15D:
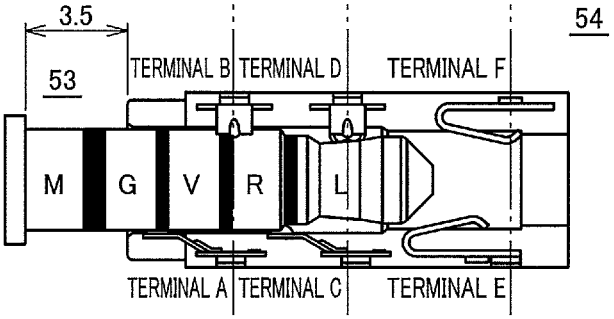

As shown in FIG. 15D, in Stage 9, the left audio terminal (L) of five-electrode plug 53 can be connected to the terminal D (Rch) of earphone jack 54, the right audio terminal (R) of five-electrode plug 53 can be connected to the terminal B (GND) and the terminal C (VDD) of earphone jack 54, and the ground terminal (G) of five-electrode plug 53 can be connected to the terminal A (MIC) of earphone jack 54.

Figure 15E:
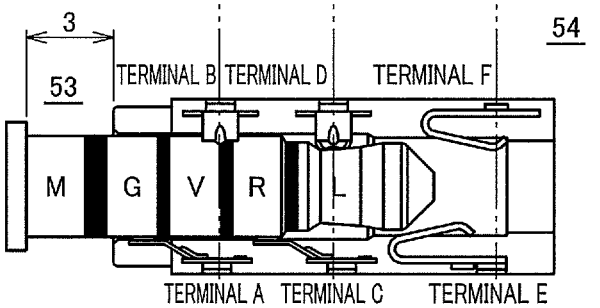

As shown in FIG. 15E, in Stage 10, the left audio terminal (L) of five-electrode plug 53 can be connected to the terminal D (Rch) of earphone jack 54, the right audio terminal (R) of five-electrode plug 53 can be connected to the terminal C (VDD) of earphone jack 54, the power supply terminal (V) of five-electrode plug 53 can be connected to the terminal B (GND) of earphone jack 54, and the ground terminal (G) of five-electrode plug 53 can be connected to the terminal A (MIC) of earphone jack 54.

FIGS. 16A to 16E are diagrams showing a Stage 11 to a Stage 15 in the process of insertion of five-electrode plug 53 into earphone jack 54, respectively.

Figure 16A:
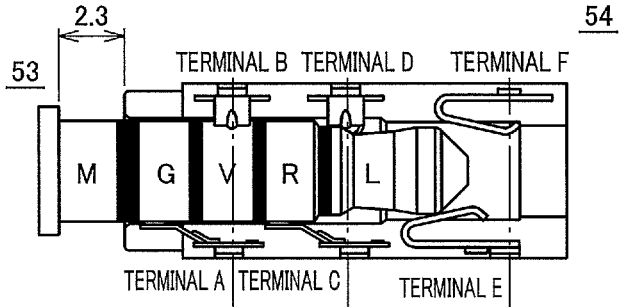
FIGS. 16A to 16E are diagrams showing a Stage 11, a Stage 12, a Stage 13, a Stage 14, and a Stage 15 in the process of insertion of the five-electrode plug into the earphone jack, respectively.

As shown in FIG. 16A, in Stage 11, the left audio terminal (L) of five-electrode plug 53 can be connected to the terminal D (Rch) and the terminal E (Lch) of earphone jack 54, the right audio terminal (R) of five-electrode plug 53 can be connected to the terminal C (VDD) of earphone jack 54, the power supply terminal (V) of five-electrode plug 53 can be connected to the terminal B (GND) of earphone jack 54, and the ground terminal (G) of five-electrode plug 53 can be connected to the terminal A (MIC) of earphone jack 54.

Figure 16B:
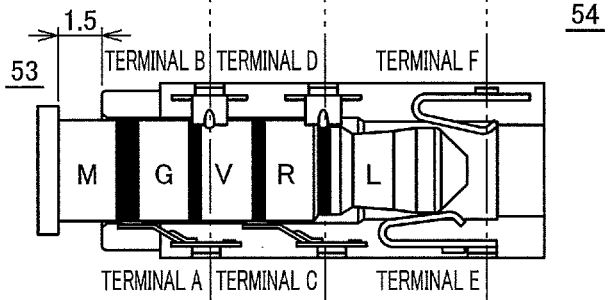

As shown in FIG. 16B, in Stage 12, the left audio terminal (L) of five-electrode plug 53 can be connected to the terminal E (Lch) of earphone jack 54, the right audio terminal (R) of five-electrode plug 53 can be connected to the terminal D (Rch) of earphone jack 54, the power supply terminal (V) of five-electrode plug 53 can be connected to the terminal B (GND) and the terminal C (VDD) of earphone jack 54, and the ground terminal (G) of five-electrode plug 53 can be connected to the terminal A (MIC) of earphone jack 54.

Figure 17:
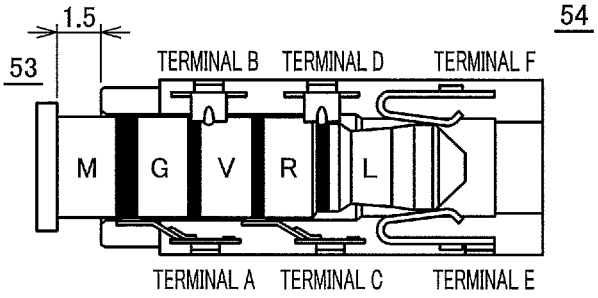
FIG. 17 is a diagram showing Stage 12 in the process of insertion of the five-electrode plug into the earphone jack when a position of a terminal F of the earphone jack is displaced toward the insertion port.

FIG. 17 is shown for the purpose of reference and it is a diagram showing Stage 12 in the process of insertion of five-electrode plug 53 into earphone jack 54 when a position of the terminal F (DET) of earphone jack 54 is displaced toward the insertion port.

As shown in FIG. 17, the left audio terminal (L) of five-electrode plug 53 can be connected to the terminal E (Lch) and the terminal F (DET) of earphone jack 54, the right audio terminal (R) of five-electrode plug 53 can be connected to the terminal D (Rch) of earphone jack 54, the power supply terminal (V) of five-electrode plug 53 can be connected to the terminal B (GND) and the terminal C (VDD) of earphone jack 54, and the ground terminal (G) of five-electrode plug 53 can be connected to the terminal A (MIC) of earphone jack 54.

As the left audio terminal (L) of five-electrode plug 53 is connected to the terminal E (Lch) and the terminal F (DET) of earphone jack 54, determination as YES is made in step S102 in the flowchart in FIG. 13 and determination as five-electrode plug 53 being inserted in earphone jack 54 can be made. When determination as being inserted is made, determination processing in step S103 or later in the flowchart in FIG. 13 is performed. When identification as five-electrode plug 53 is made, power supply voltage VDD can be supplied in step S108. In this state, however, the power supply terminal (V) of five-electrode plug 53 supplied with power supply voltage VDD is connected to the terminal B (GND) of earphone jack 54 and hence short-circuiting occurs.

In contrast, in FIG. 16B, the left audio terminal (L) of five-electrode plug 53 is not connected to the terminal F (DET) of earphone jack 54. Therefore, determination as NO is made in step S102 in the flowchart in FIG. 13 and determination as five-electrode plug 53 being inserted in earphone jack 54 is not made. Consequently, power supply voltage VDD is not supplied to the power supply terminal (V) of five-electrode plug 53 and short-circuiting can be prevented from occurring.

Figure 16C:
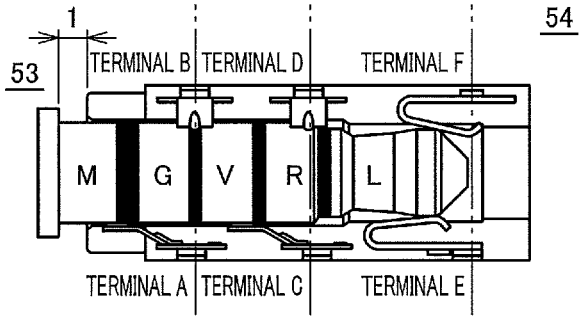

Referring again to FIG. 16, as shown in FIG. 16C, in Stage 13, the left audio terminal (L) of five-electrode plug 53 can be connected to the terminal E (Lch) and the terminal F (DET) of earphone jack 54, the right audio terminal (R) of five-electrode plug 53 can be connected to the terminal D (Rch) of earphone jack 54, the power supply terminal (V) of five-electrode plug 53 can be connected to the terminal C (VDD) of earphone jack 54, and the microphone terminal (M) of five-electrode plug 53 can be connected to the terminal A (MIC) of earphone jack 54.

In this state, as the left audio terminal (L) of five-electrode plug 53 is connected to the terminal E (Lch) and the terminal F (DET) of earphone jack 54, determination as five-electrode plug 53 being inserted in earphone jack 54 can be made. When determination as being inserted is made and identification as five-electrode plug 53 is further made, power supply voltage VDD can be supplied. In this state, since the power supply terminal (V) of five-electrode plug 53 supplied with power supply voltage VDD is not connected to the terminal B (GND) of earphone jack 54, short-circuiting does not occur.

Figure 16D:
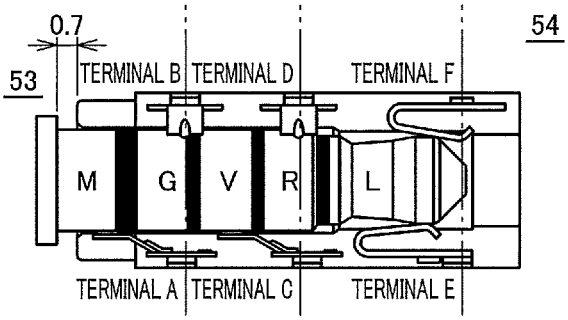
Figure 16E:
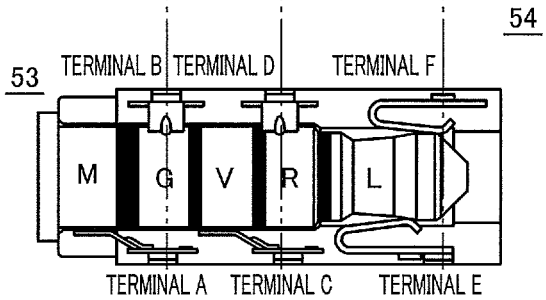

As shown in FIGS. 16D and 16E, in Stage 14 and Stage 15, the left audio terminal (L) of five-electrode plug 53 can be connected to the terminal E (Lch) and the terminal F (DET) of earphone jack 54, the right audio terminal (R) of five-electrode plug 53 can be connected to the terminal D (Rch) of earphone jack 54, the power supply terminal (V) of five-electrode plug 53 can be connected to the terminal C (VDD) of earphone jack 54, and the ground terminal (G) of five-electrode plug 53 can be connected to the terminal B (GND) of earphone jack 54.

As set forth above, according to the portable terminal and the five-electrode plug earphone in an embodiment, the earphone jack side of the portable terminal and the plug side of the five-electrode plug earphone include terminals for the power supply voltage, so that the power supply voltage can be supplied to the piezoelectric element in the five-electrode plug earphone.

With the terminals of the five-electrode plug being aligned sequentially in the order of the left audio terminal (L), the right audio terminal (R), the power supply terminal (V), the ground terminal (GND), and the microphone terminal (M) from the tip end, the portable terminal including an earphone jack for five electrodes can also be connected to the three-electrode plug earphone and the four-electrode plug earphone described in the background art.

In an embodiment, a difference in impedance between the speaker included in the three-electrode plug earphone and the four-electrode plug earphone and the differential amplifier included in the five-electrode plug earphone is made use of, so that whether an earphone inserted in the earphone jack is the five-electrode plug earphone, the three-electrode plug earphone, or the four-electrode plug earphone can be identified.

In an embodiment, after the inserted earphone has been identified as the five-electrode plug earphone, the power supply voltage is supplied from the portable terminal to the five-electrode plug. When the power supply terminal (V) of the five-electrode plug is connected to the terminal B (GND) of the earphone jack, the left audio terminal (L) of the five-electrode plug is not connected to the terminal F (DET) of the earphone jack and hence short-circuiting can be prevented from occurring.

Though a portable terminal is described by way of example of an electronic device in an embodiment described above, the electronic device in the present disclosure is not limited to the portable terminal but devices such as personal computers or tablets are also encompassed.

In an embodiment, though resistor RX which is an equalization circuit of speaker 17*a* and resistor RY which is an equalization circuit of speaker 17*b* have a value of 8Ω, limitation thereto is not intended. Even when resistors RX and RY have a value of 16Ω or 32Ω, determination of insertion and removal of the plug and identification of a type of the plug described in an embodiment are applicable.

Though a voltage is supplied to a piezoelectric element in an earphone in an embodiment, a component supplied with a voltage is not limited to a piezoelectric element and other components may be supplied with a voltage. For example, a light emitting element and a light reception element for sensing beats may be applicable.

It should be understood that an embodiment disclosed herein is illustrative and non-restrictive in every respect. The scope of the present disclosure is defined by the terms of the claims rather than the description above and is intended to include any modifications within the scope and meaning equivalent to the terms of the claims.

The invention claimed is:

1. A five-electrode plug earphone comprising:

a first differential amplifier configured to include a first input terminal, a second input terminal, a power supply terminal, and a ground terminal and to amplify a difference between a voltage of the first input terminal and a voltage of the second input terminal;

a second differential amplifier configured to include a first input terminal, a second input terminal, a power supply terminal, and a ground terminal and to amplify a difference between a voltage of the first input terminal and a voltage of the second input terminal;

a first piezoelectric element configured to receive a voltage amplified by the first differential amplifier, a second piezoelectric element configured to receive a voltage amplified by the second differential amplifier;

a microphone including an output terminal and a ground terminal; and a five-electrode plug including a first terminal, a second terminal, a third terminal, a fourth terminal, and a fifth terminal sequentially from a tip end, the first terminal being configured to be connected to the first input terminal of the first differential amplifier, the second terminal being configured to be connected to the first input terminal of the second differential amplifier, the third terminal being configured to be connected to the power supply terminal of the first differential amplifier and the power supply terminal of the second differential amplifier, the fourth terminal being configured to be connected to the ground terminal of the first differential amplifier, the ground terminal of the second differential amplifier, and the ground terminal of the microphone and further configured to be connected to the second input terminal of the first differential amplifier and the second input terminal of the second differential amplifier, and the fifth terminal being configured to be connected to the output terminal of the microphone.

2. An electronic device comprising:

an earphone jack which can be connected to a five-electrode plug earphone, the earphone jack including a first terminal, a second terminal, a third terminal, a fourth terminal, a fifth terminal, and a sixth terminal in an order of proximity to an insertion port;

a microphone audio processing unit configured to be connected to the first terminal of the earphone jack;

a ground power supply configured to be connected to the second terminal of the earphone jack;

an electric power supply unit configured to be connected to the third terminal of the earphone jack;

a first audio output unit configured to be connected to the fourth terminal of the earphone jack;

a second audio output unit configured to be connected to the fifth terminal of the earphone jack; and a processor configured to be connected to the sixth terminal of the earphone jack and configured to determine insertion of a plug into the earphone jack.

3. The electronic device according to claim 2, wherein the first terminal, the third terminal, and the fifth terminal are configured to be arranged along a first line in parallel to a direction of insertion over a cylindrical inner wall of the earphone jack, and the second terminal, the fourth terminal, and the sixth terminal are configured to be arranged along a second line in parallel to the direction of insertion over the cylindrical inner wall of the earphone jack and opposed to the first line.

4. The electronic device according to claim 2, wherein the five-electrode plug earphone includes a first differential amplifier configured to include a first input terminal, a second input terminal, a power supply terminal, and a ground terminal and to amplify a difference between a voltage of the first input terminal and a voltage of the second input terminal, a second differential amplifier configured to include a first input terminal, a second input terminal, a power supply terminal, and a ground terminal and to amplify a difference between a voltage of the first input terminal and a voltage of the second input terminal, a first piezoelectric element configured to receive a voltage amplified by the first differential amplifier, a second piezoelectric element configured to receive a voltage amplified by the second differential amplifier, a microphone including an output terminal and a ground terminal, and a five-electrode plug including a first terminal, a second terminal, a third terminal, a fourth terminal, and a fifth terminal sequentially from a tip end, the first terminal of the five-electrode plug is configured to be connected to the first input terminal of the first differential amplifier, the second terminal of the five-electrode plug is configured to be connected to the first input terminal of the second differential amplifier, the third terminal of the five-electrode plug is configured to be connected to the power supply terminal of the first differential amplifier and the power supply terminal of the second differential amplifier, the fourth terminal of the five-electrode plug is configured to be connected to the ground terminal of the first differential amplifier, the ground terminal of the second differential amplifier, and the ground terminal of the microphone and configured to be connected to the second input terminal of the first differential amplifier and the second input terminal of the second differential amplifier, the fifth terminal of the five-electrode plug is configured to be connected to the output terminal of the microphone, and when the five-electrode plug earphone is completely inserted in the earphone jack, the first terminal of the earphone jack is configured to be connected to the fifth terminal of the five-electrode plug, the second terminal of the earphone jack is configured to be connected to the fourth terminal of the five-electrode plug, the third terminal of the earphone jack is configured to be connected to the third terminal of the five-electrode plug, the fourth terminal of the earphone jack is configured to be connected to the second terminal of the five-electrode plug, the fifth terminal of the earphone jack is configured to be connected to the first terminal of the five-electrode plug, and the sixth terminal of the earphone jack is configured to be connected to the first terminal of the five-electrode plug.

5. The electronic device according to claim 4, wherein the earphone jack can be connected also to a three-electrode plug earphone, the three-electrode plug earphone includes a first speaker including an input terminal and a ground terminal, a second speaker including an input terminal and a ground terminal, and a three-electrode plug including a first terminal, a second terminal, and a third terminal sequentially from a tip end, the first terminal of the three-electrode plug is configured to be connected to the input terminal of the first speaker, the second terminal of the three-electrode plug is configured to be connected to the input terminal of the second speaker, the third terminal of the three-electrode plug is configured to be connected to the ground terminal of the first speaker and the ground terminal of the second speaker, and when the three-electrode plug earphone is completely inserted in the earphone jack, the first terminal of the earphone jack is configured to be connected to the third terminal of the three-electrode plug, the second terminal of the earphone jack is configured to be connected to the third terminal of the three-electrode plug, the third terminal of the earphone jack is configured to be connected to the third terminal of the three-electrode plug, the fourth terminal of the earphone jack is configured to be connected to the second terminal of the three-electrode plug, the fifth terminal of the earphone jack is configured to be connected to the first terminal of the three-electrode plug, and the sixth terminal of the earphone jack is configured to be connected to the first terminal of the three-electrode plug.

6. The electronic device according to claim 4, wherein the earphone jack can be connected also to a four-electrode plug earphone, the four-electrode plug earphone includes a first speaker including an input terminal and a ground terminal, a second speaker including an input terminal and a ground terminal, a microphone including an output terminal and a ground terminal, and a four-electrode plug including a first terminal, a second terminal, a third terminal, and a fourth terminal sequentially from a tip end, the first terminal of the four-electrode plug is configured to be connected to the input terminal of the first speaker, the second terminal of the four-electrode plug is configured to be connected to the input terminal of the second speaker, the third terminal of the four-electrode plug is configured to be connected to the ground terminal of the first speaker, the ground terminal of the second speaker, and the ground terminal of the microphone, the fourth terminal of the four-electrode plug is configured to be connected to the output terminal of the microphone, and when the four-electrode plug earphone is completely inserted into the earphone jack, the first terminal of the earphone jack is configured to be connected to the fourth terminal of the four-electrode plug, the second terminal of the earphone jack is configured to be connected to the third terminal of the four-electrode plug, the third terminal of the earphone jack is configured to be connected to the third terminal of the four-electrode plug, the fourth terminal of the earphone jack is configured to be connected to the second terminal of the four-electrode plug, the fifth terminal of the earphone jack is configured to be connected to the first terminal of the four-electrode plug, and the sixth terminal of the earphone jack is configured to be connected to the first terminal of the four-electrode plug.

7. The electronic device according to claim 4, wherein the earphone jack can be connected also to a three-electrode plug earphone and a four-electrode plug earphone, the three-electrode plug earphone includes a first speaker including an input terminal and a ground terminal, a second speaker including an input terminal and a ground terminal, and a three-electrode plug including a first terminal, a second terminal, and a third terminal sequentially from a tip end, the first terminal of the three-electrode plug is configured to be connected to the input terminal of the first speaker, the second terminal of the three-electrode plug is configured to be connected to the input terminal of the second speaker, the third terminal of the three-electrode plug is configured to be connected to the ground terminal of the first speaker and the ground terminal of the second speaker, when the three-electrode plug earphone is completely inserted into the earphone jack, the first terminal of the earphone jack is configured to be connected to the third terminal of the three-electrode plug, the second terminal of the earphone jack is configured to be connected to the third terminal of the three-electrode plug, the third terminal of the earphone jack is configured to be connected to the third terminal of the three-electrode plug, the fourth terminal of the earphone jack is configured to be connected to the second terminal of the three-electrode plug, the fifth terminal of the earphone jack is configured to be connected to the first terminal of the three-electrode plug, and the sixth terminal of the earphone jack is configured to be connected to the first terminal of the three-electrode plug, the four-electrode plug earphone includes a first speaker including an input terminal and a ground terminal, a second speaker including an input terminal and a ground terminal, a microphone including an output terminal and a ground terminal, and a four-electrode plug including a first terminal, a second terminal, a third terminal, and a fourth terminal sequentially from a tip end, the first terminal of the four-electrode plug is configured to be connected to the input terminal of the first speaker, the second terminal of the four-electrode plug is configured to be connected to the input terminal of the second speaker, the third terminal of the four-electrode plug is configured to be connected to the ground terminal of the first speaker, the ground terminal of the second speaker, and the ground terminal of the microphone, the fourth terminal of the four-electrode plug is configured to be connected to the output terminal of the microphone, and when the four-electrode plug earphone is completely inserted into the earphone jack, the first terminal of the earphone jack is configured to be connected to the fourth terminal of the four-electrode plug, the second terminal of the earphone jack is configured to be connected to the third terminal of the four-electrode plug, the third terminal of the earphone jack is configured to be connected to the third terminal of the four-electrode plug, the fourth terminal of the earphone jack is configured to be connected to the second terminal of the four-electrode plug, the fifth terminal of the earphone jack is configured to be connected to the first terminal of the four-electrode plug, and the sixth terminal of the earphone jack is configured to be connected to the first terminal of the four-electrode plug.

8. The electronic device according to claim 4, the electronic device further comprising:

a pull-up resistor connected to a first node on a line between the sixth terminal of the earphone jack and the processor, and a pull-down resistor configured to be connected to a second node on a line between the fifth terminal of the earphone jack and the second audio output unit, wherein the pull-up resistor is higher in resistance value than the pull-down resistor, and the processor is configured to determine that the earphone has been inserted into the earphone jack when a voltage of the first node is at a low level.

9. The electronic device according to claim 5, the electronic device further comprising a pull-up resistor configured to be connected to a third node on a line between the first terminal of the earphone jack and the microphone audio processing unit, wherein the processor is configured to identify an earphone inserted into the earphone jack as the three-electrode plug earphone when a voltage of the third node is at a low level.

10. The electronic device according to claim 5, the electronic device further comprising:

a pull-up resistor configured to be connected to a third node on a line between the first terminal of the earphone jack and the microphone audio processing unit; and an inverter configured to receive a voltage of the third node, wherein the processor is configured to identify an earphone inserted in the earphone jack as the three-electrode plug earphone when output from the inverter is at a high level.

11. The electronic device according to claim 5, wherein a fourth node on a line between the fourth terminal of the earphone jack and the first audio output unit is configured to be connected further to the processor, the processor is configured to pull up the fourth node, and the processor is configured to identify an earphone inserted in the earphone jack as the five-electrode plug earphone when a voltage of the fourth node is at a high level.

12. The electronic device according to claim 11, wherein the processor is configured to start supply of electric power to the second terminal of the earphone jack from the electric power supply unit after the earphone inserted in the earphone jack has been identified as the five-electrode plug earphone.

13. The electronic device according to claim 12, wherein when the first terminal of the five-electrode plug is connected to the fifth terminal and the sixth terminal of the earphone jack during a process of insertion of the five-electrode plug earphone into the earphone jack, the third terminal of the five-electrode plug is configured not to be connected to the second terminal of the earphone jack.

14. The electronic device according to claim 7, the electronic device further comprising:

a pull-up resistor configured to be connected to a third node on a line between the first terminal of the earphone jack and the microphone audio processing unit; and an inverter configured to receive a voltage of the third node, wherein a fourth node on a line between the fourth terminal of the earphone jack and the first audio output unit is configured to be connected further to the processor, the processor is configured to pull up the fourth node, and the processor is configured to identify an earphone inserted into the earphone jack as the four-electrode plug earphone when output from the inverter is at a low level and a voltage of the fourth node is at a low level.

15. An electronic device system comprising:

a five-electrode plug earphone; and an electronic device, the five-electrode plug earphone including a first differential amplifier configured to include a first input terminal, a second input terminal, a power supply terminal, and a ground terminal and to amplify a difference between a voltage of the first input terminal and a voltage of the second input terminal, a second differential amplifier configured to include a first input terminal, a second input terminal, a power supply terminal, and a ground terminal and to amplify a difference between a voltage of the first input terminal and a voltage of the second input terminal, a first piezoelectric element configured to receive a voltage amplified by the first differential amplifier, a second piezoelectric element configured to receive a voltage amplified by the second differential amplifier, a microphone including an output terminal and a ground terminal, and a five-electrode plug including a first terminal, a second terminal, a third terminal, a fourth terminal, and a fifth terminal sequentially from a tip end, the first terminal being configured to be connected to the first input terminal of the first differential amplifier, the second terminal being configured to be connected to the first input terminal of the second differential amplifier, the third terminal being configured to be connected to the power supply terminal of the first differential amplifier and the power supply terminal of the second differential amplifier, the fourth terminal being configured to be connected to the ground terminal of the first differential amplifier, the ground terminal of the second differential amplifier, and the ground terminal of the microphone and further configured to be connected to the second input terminal of the first differential amplifier and the second input terminal of the second differential amplifier, the fifth terminal being configured to be connected to the output terminal of the microphone, the electronic device including an earphone jack which can be connected to a five-electrode plug earphone, the earphone jack including a first terminal, a second terminal, a third terminal, a fourth terminal, a fifth terminal, and a sixth terminal in an order of proximity to an insertion port, a microphone audio processing unit configured to be connected to the first terminal of the earphone jack, a ground power supply configured to be connected to the second terminal of the earphone jack, an electric power supply unit configured to be connected to the third terminal of the earphone jack, a first audio output unit configured to be connected to the fourth terminal of the earphone jack, a second audio output unit configured to be connected to the fifth terminal of the earphone jack, and a processor configured to be connected to the sixth terminal of the earphone jack and configured to determine insertion of the five-electrode plug into the earphone jack.

* * * * *